United States Patent [19]

Logan

[11] 4,117,434

[45] Sep. 26, 1978

[54] HYBRID DEFLECTION SYSTEM WITH QUADRIPOLAR CORRECTION COILS

[75] Inventor: James H. Logan, Baldwinsville, N.Y.

[73] Assignee: General Electric Company, Portsmouth, Va.

[21] Appl. No.: 760,572

[22] Filed: Jan. 19, 1977

[51] Int. Cl.[2] ..... H01F 5/02

[52] U.S. Cl. ..... 335/213; 335/210

[58] Field of Search ..... 335/213, 210

[56] References Cited

U.S. PATENT DOCUMENTS

| | | | |
|---|---|---|---|
| 3,849,749 | 11/1974 | Kadota | 335/210 |
| 4,038,621 | 7/1977 | Chiodi et al. | 335/213 |

FOREIGN PATENT DOCUMENTS

| | | | |
|---|---|---|---|
| 1,323,154 | 7/1973 | United Kingdom | 335/213 |

*Primary Examiner*—Harold Broome

[57] ABSTRACT

A hybrid deflection system for a cathode ray tube in which toroidal-type quadripolar correction coils, having areas vacant of any windings within the coils, lie wound in accordance with a Fourier series winding distribution on a split ring magnetic core of the deflection system comprising saddle-type horizontal deflection coils and toroidal-type vertical deflection coils. Selected vacant areas of the quadripolar coils are positioned coincident with breaks in the split ring magnetic core to allow assembly of the core around the saddle-type horizontal deflection coils.

15 Claims, 18 Drawing Figures

Fig. 1
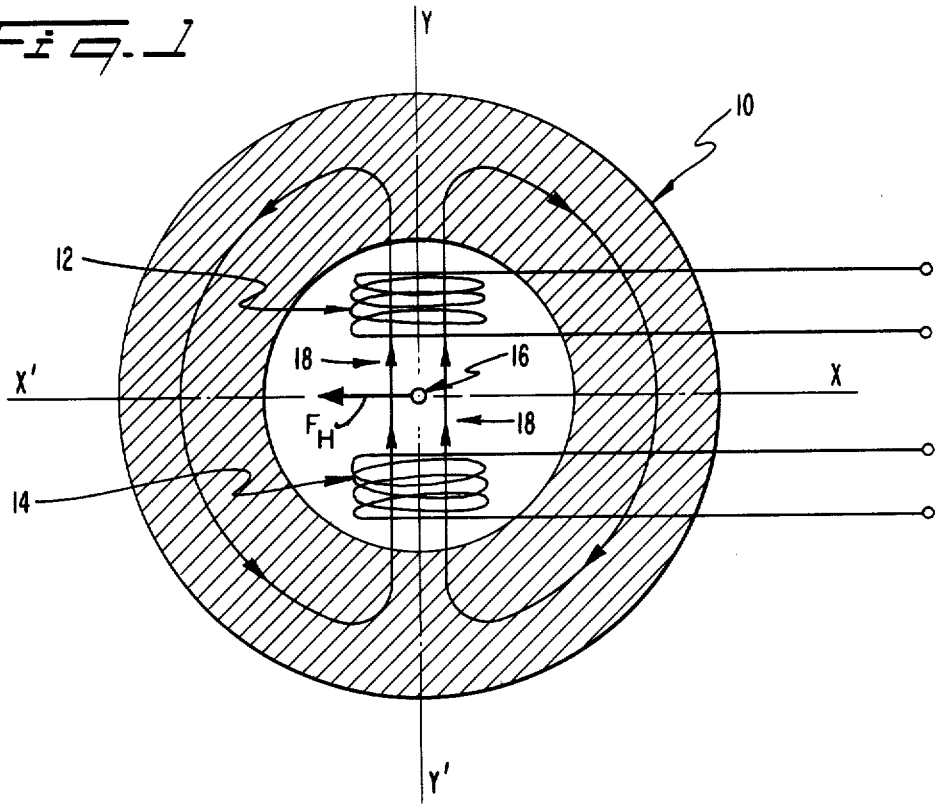
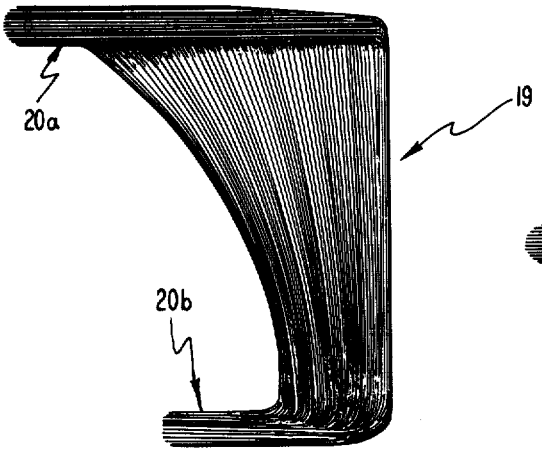
Fig. 2A
Fig. 2B
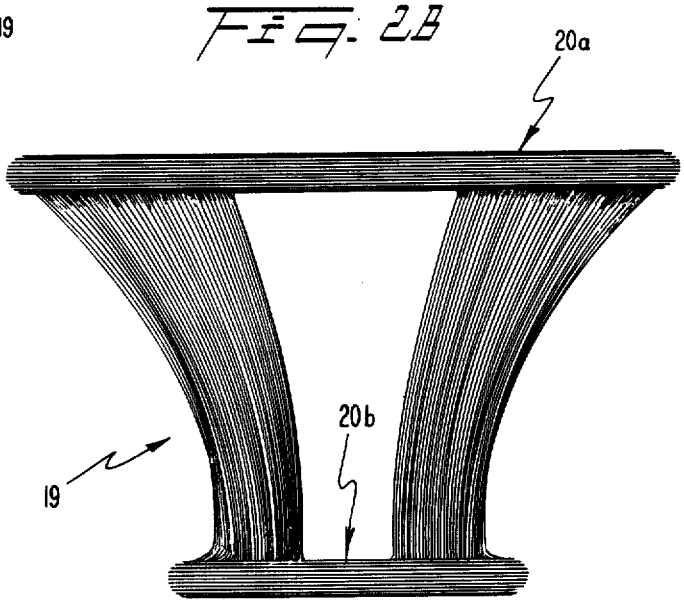

Fig. 2C
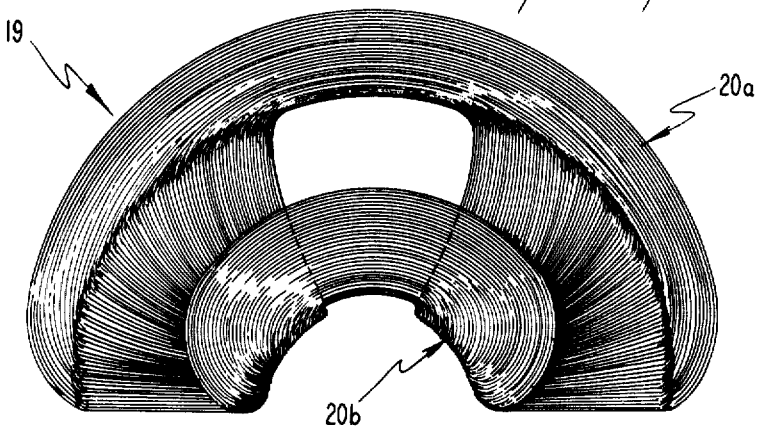
Fig. 2D
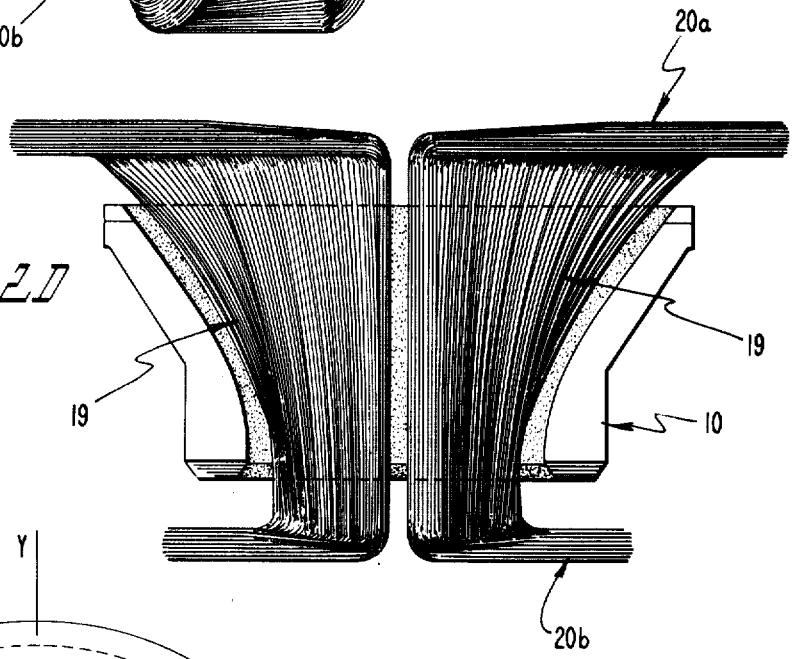
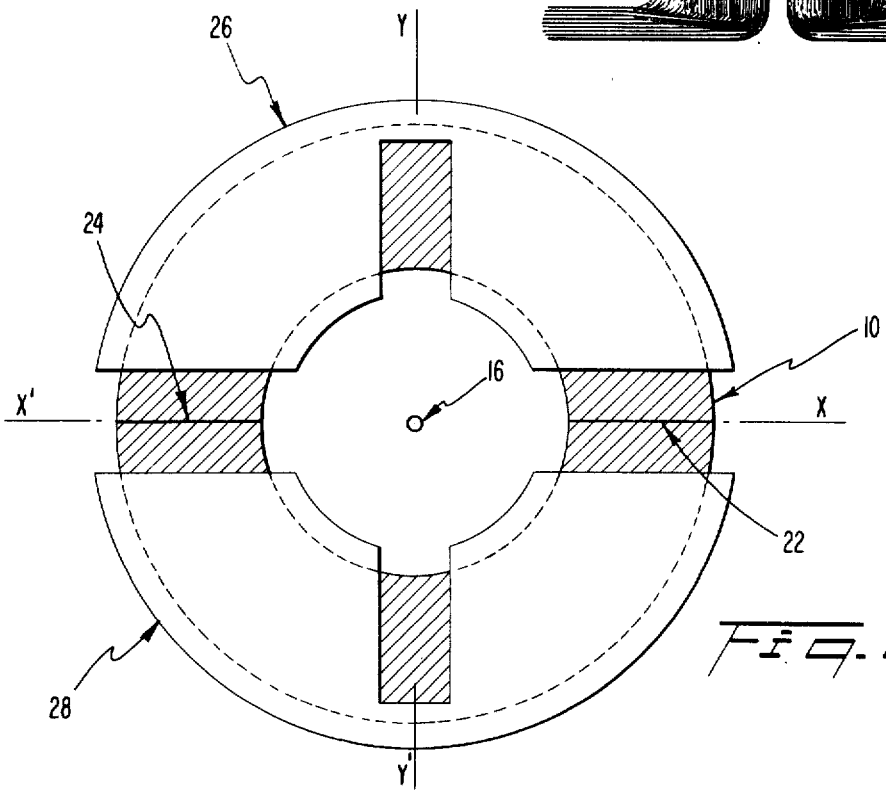
Fig. 3 n(θ)
100%
80%
60%
40%
20%
A2 SIN 2θ
A6 SIN 6θ
θ
Y=0°
A=45°
X=90°
35°
55°
52
54
Y=0°
A
X=90°

NON-SYMMETRICAL

Y=0°
A=45°
X=90°
VOID AREA
n(θ)
SYMMETRICAL
100%
80%
60%
40%
20%
ε 1.1 SIN 2θ + .0197 SIN 6θ
- .187 SIN 10θ
- .1201 SIN 14θ
Y=0°
9°
A=45°
81°
X=90°

52
54
VOID AREA
VOID AREA
Y=0°
A=45°
X=90°

HYBRID DEFLECTION SYSTEM WITH QUADRIPOLAR CORRECTION COILS

BACKGROUND OF THE INVENTION

The present invention relates a deflection system with quadripolar correction coils for use with a cathode ray tube and more particularly to a quadripolar correction coil configuration which is easily manageable in terms of deflection system design and yet allows for mechanical assembly of a split ring magnetic core, on which toroidal-type vertical deflection coils are mounted, around saddle-type horizontal deflection coils.

In conventional black and white television receivers, horizontal and vertical deflection coils are energized to bend the electron beam in a cathode ray tube causing the beam to scan across the entire face of the cathode ray tube in the horizontal and vertical directions.

Deflection coils traditionally comprise a pair of either toroidal or saddle-shaped coils mounted on an annular or ring-shaped ferromagnetic core. Toroidal coils can be wound directly on a solid ring magnetic core but the current state of technology requires that commercially acceptable saddle coils be pre-wound and thereafter mounted on the core. Since the flared ends of a saddle coil exceed the inner diameter of the core, the core must be split into at least two separate pieces and then reassembled around the pre-wound saddle windings. A core broken in such a manner is referred to as a split ring magnetic core.

Horizontal and vertical deflection coils may be all toroidal, all saddle, or one set toroidal and one set saddle. However, the power consumed by deflection coils is dependent both on the type of coil and the frequency at which the coil is operated. It is generally recognized in the television industry that in a horizontal deflection circuit which operates at a high frequency such as the 15,750 cycle per second frequency used in United States commercial television, less energy is consumed driving saddle horizontal deflection coils than is needed to drive toroidal horizontal deflection coils. Further, it is generally recognized that in a high impedance vertical deflection circuit which operates at a low frequency such as the 60 cycle per second frequency used in the United States, less energy is consumed driving toroidal vertical deflection coils than is needed to drive saddle vertical deflection coils.

Accordingly, the deflection system which offers minimum power consumption is one which uses deflection coils in a hybrid arrangement with the higher frequency horizontal coils of a saddle-type and the lower frequency vertical coils of a toroidal-type.

When using such a hybrid system, the magnetic core is split at the vacant areas which occur along the horizontal axis of the core between the toroidal vertical coils to allow assembly of the core around the pre-wound saddle-type horizontal coils.

Conventional color television receivers employ plural beam cathode ray tubes either in a triad or an in-line arrangement. The plural electron beams are deflected in a similar manner as single electron beams, but additional corrective coils may be required or desired to assure proper convergence of the plural beams at the point of impact on the face of the tube. As evidenced by British Pat. No. 1,323,154 to Philips Electronic and Associated Industries, Ltd., published July 11, 1973, quadripolar correction coils are known to provide a means of assuring proper convergence in plural beam tubes.

Quadripolar correction coils in an in-line system usually comprise four individual coils mounted on the magnetic core to establish alternate north and south poles along the diagonals of the deflection system. Typically, the quadripolar coils are toroidal in form because saddle quadripolar coils result in mounting and alignment requirements which are extremely complex and in a coil size which is so bulky as to require an unreasonably large core. Instead, toroidal quadripolar coils have been used with saddle horizontal and saddle vertical deflection coils. To produce the alternate north and south poles along the diagonals of the deflection system, the toroidal quadripolar coils are centered along the horizontal and vertical axes of the system. In such cases, the necessary break in the core to allow for assembly of the core around the saddle-shaped horizontal and vertical deflection coils can be located anywhere between adjoining quadripolar coils.

An apparently insurmountable fabrication problem arises, however, in the use of toroidal-type quadripolar coils with the more efficient deflection system comprising saddle-type horizontal coils and toroidal-type vertical coils. To establish alternate north and south poles along the diagonals of the deflection system, conventional toroidal quadripolar coils are located along the horizontal axis of the system, but these quadripolar coils then overlie the horizontal axis separation on the core between the toroidal vertical deflection coils and thereby eliminate any vacant areas at which the core can be split to allow assembly of the core around the pre-wound saddle-type horizontal coils.

Movement of the quadripolar coils or windings of the coils away from the horizontal axis based solely on the need to allow for splitting and reassembly of the core results in an unsatisfactory quadripolar magnetic correction field.

Specifically, the shape of the required quadripolar magnetic correction field is dependent on a number of factors including the shape of the horizontal and vertical deflection fields, the shape of the cathode ray tube and the waveform of excitation signals used to generate the quadripolar, horizontal and vertical fields. The interrelationship of these factors is extremely intricate and a change in one requires reanalysis and redesign of the entire system. Accordingly, redesign of the quadripolar coils based only on the need to provide enough vacant area on the core to allow assembly of the core around the saddle horizontal coils results in a quadripolar correction field which requires reanalysis and redesign of the entire deflection system. This can be a costly and, for some changes in the quadripolar coil configuration, nearly impossible task.

It is accordingly an object of the present invention to provide a low energy consuming deflection system with toroidal quadripolar deflection coils.

It is another object of the present invention to provide a hybrid deflection system with quadripolar correction coils, the quadripolar correction coils having a configuration which provides a satisfactory quadripolar correction field and yet allows for assembly of a split ring magnetic core around saddle-type deflection windings.

It is a further object of the present invention to provide toroidal-type quadripolar correction coils which are readily compatible for use with saddle-type horizontal deflection coils and torroidal-type vertical deflection coils.

SUMMARY OF THE INVENTION

To achieve the foregoing objects and in accordance with the purposes of the invention as embodied and broadly described herein, the hybrid deflection system with quadripolar correction coils of this invention comprises high efficiency horizontal and vertical deflection coils mounted on a split ring magnetic core with the deflection coils having at least two empty limited areas having no windings on the core at which breaks in the core are located. A quadripolar correction system having a plurality of symmetrical coils is wound on the core with at least a portion of the quadripolar coils covering the empty limited areas on the core. Each of at least two of the quadripolar coils has an area void of windings, with two of the void areas in the quadripolar coils being each located respectively coincident with one of the two breaks in the core and being of sufficient magnitude to allow assembly of the core.

In a preferred embodiment of the invention, the hybrid deflection system comprises saddle-type horizontal deflection coils and toroidal-type vertical deflection coils having only two limited areas without windings on the core, each limited area located at one intersection of the core and the horizontal axis of the deflection system. In this embodiment, the quadripolar correction system comprises four toroidal-type quadripolar coils, each wound in accordance with an even Fourier series distribution with two of the coils centered at the intersection of the core and the horizontal axis of the deflection system and with each of the four coils having a void area respectively coincident with one intersection of the core and the horizontal and vertical axes of the deflection system to allow assembly of the core along the horizontal axis of the deflection system.

DESCRIPTION OF THE DRAWINGS

A greater appreciation of the objects and advantages of the invention may be understood by a detailed description taken in conjunction with the drawings, wherein:

FIG. 1 is a diagrammatic cross section of a horizontal deflection system using saddle coils;

FIG. 2A, 2B and 2C are side, top and end views respectively of one saddle coil;

FIG. 2D is a side cross sectional view of a ring core assembled around saddle-type deflection coils;

FIG. 3 is a diagram of saddle-type horizontal deflection coils mounted in a ring core;

FIG. 9 shows a sample analysis of quadripolar correction coils Fourier series winding distribution in accordance with the teachings of the present invention wherein

DETAILED DESCRIPTION

Figure 4:
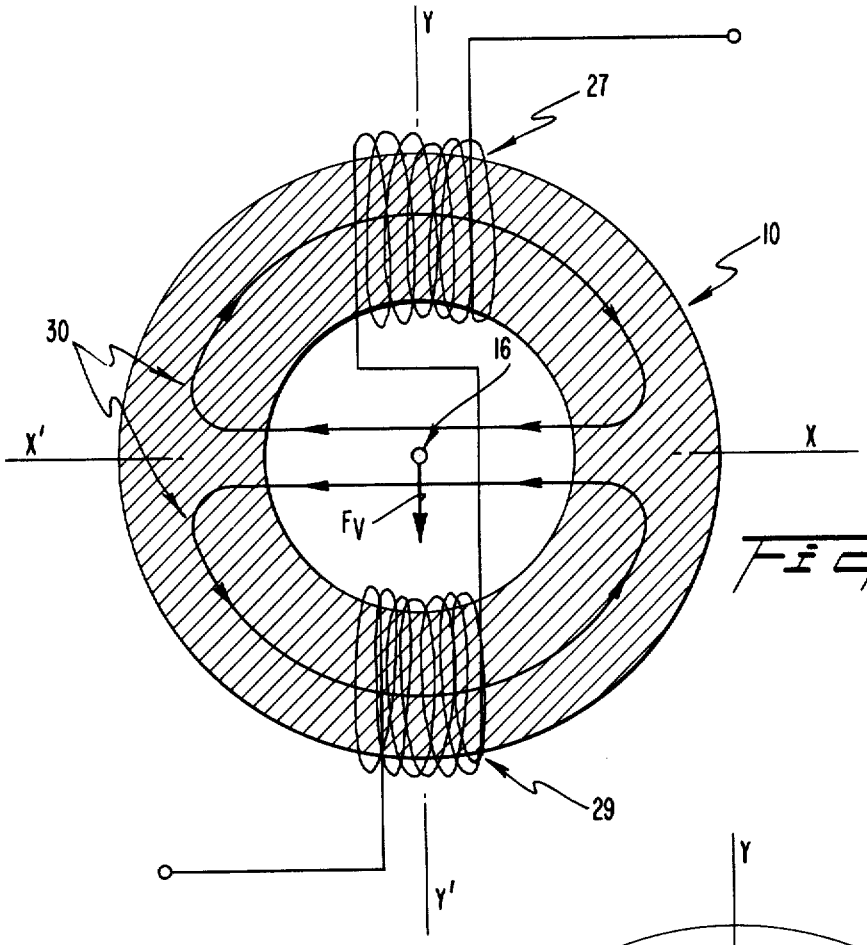
FIG. 4 is a diagrammatic cross section of a vertical deflection system using toroidal coils.

Reference will now be made in detail to the present preferred embodiment of the invention, an example of which is illustrated in the accompanying drawings.

Referring to FIG. 1, there is shown a diagrammatic cross section of a horizontal deflection system having a horizontal axis X—X$^1$ and a vertical axis Y—Y$^1$ and including a ring magnetic core 10, saddle horizontal deflection coils 12 and 14, and a single electron beam 16 traveling substantially perpendicular to the plane of the drawing. Flux lines 18 represent one polarity of the magnetic field which saddle coils 12 and 14 set up around and inside core 10. As illustrated, this field exerts a horizontal force $F_H$ on electron beam 16 in a first direction. Reversing the current in saddle horizontal deflection coils 12 and 14 reverses the direction of the horizontal force $F_H$ on electron beam 16 and allows for complete horizontal scanning of the beam across the face of a cathode ray tube.

In practice, saddle-shaped horizontal deflection coils 12 and 14 have flanged ends and assume the shape illustrated respectively by side, top and end views of coil 19 in FIG. 2A, 2B and 2C. Saddle-shaped coils of this nature are presently pre-wound and thereafter mounted in a ring core 10. A side cross sectional view of core 10 shown in FIG. 2D reveals that the flanges **20*a* and 20*b* on coil 19 are too large to allow mounting of coil 19 onto generally truncated conical core 10 without some splitting and reassembly of core 10. Accordingly, two diametrically positioned breaks, 22 and 24, are made in the core 10, normally along the horizontal axis X—X$^1$, as illustrated in FIG. 3, to allow mounting of saddle-type horizontal deflection coils 26 and 28 onto a core 10 by assembly of core 10 around saddle coils 26 and 28. Core 10 with breaks 22 and 24** is called a split ring magnetic core.

Referring now to FIG. 4, there is shown a diagrammatic cross section of a vertical deflection system having a horizontal axis X—X$^1$ and a vertical axis Y—Y$^1$ and including ring magnetic core 10, toroidal vertical deflection coils 27 and 29 and a single electron beam 16 traveling perpendicular to the plane of the drawing. Flux lines 30 represent one polarity of the magnetic field toroidal coils 27 and 29 set up around and inside core 10. As illustrated, the field exerts a vertical force $F_V$ on electron beam 16 in a downward direction. Reversing the current in toroidal-shaped vertical deflection coils 27 and 29 reverses the direction of the vertical force $F_V$ on electron beam 16 and allows for complete vertical scanning of the beam across the face of a cathode ray tube.

Although FIG. 4 illustrates toroidal deflection coils 27 and 29 as occupying only small areas of the core, to achieve commercially acceptable deflection systems, the toroidal deflection coils are, in fact, spread out over nearly the entire core. One example of such a deflection coil system is described in U.S. Pat. No. 3,548,350, issued to John R. Archer on Dec. 15, 1970, which is assigned to the assignee of the present application. In accordance with the Archer patent, simple toroidal-type vertical deflection coils occupy an area of about 160° each as illustrated by toroidal shaped vertical deflection coils 32 and 34 in FIG. 5. In this coil configuration, there are only two limited areas, 36 and 38, on the core 10 having no windings and these limited areas 36 and 38 lie diametrically opposed to one another adjacent the horizontal axis X—X' of the deflection system. Accordingly, if both the saddle-type horizontal deflection coils illustrated in FIG. 3 and the toroidal-type vertical deflection coils illustrated in FIG. 5 were used in the same deflection system, the breaks 22 and 24 in core 10 required to allow assembly of the core around the saddle windings would necessarily have to lie in limited areas 36 and 38 between toroidal-type deflection coils 32 and 34.

While horizontal and vertical deflection systems as illustrated above can effectively scan a single electron beam, the scanning of plural electron beams such as those found in commercial color television receivers introduces the complex problem of maintaining correct convergence of the plural beams to assure that the electron beams substantially coincide with one another at all points of impact on the face of the tube.

Figure 6:
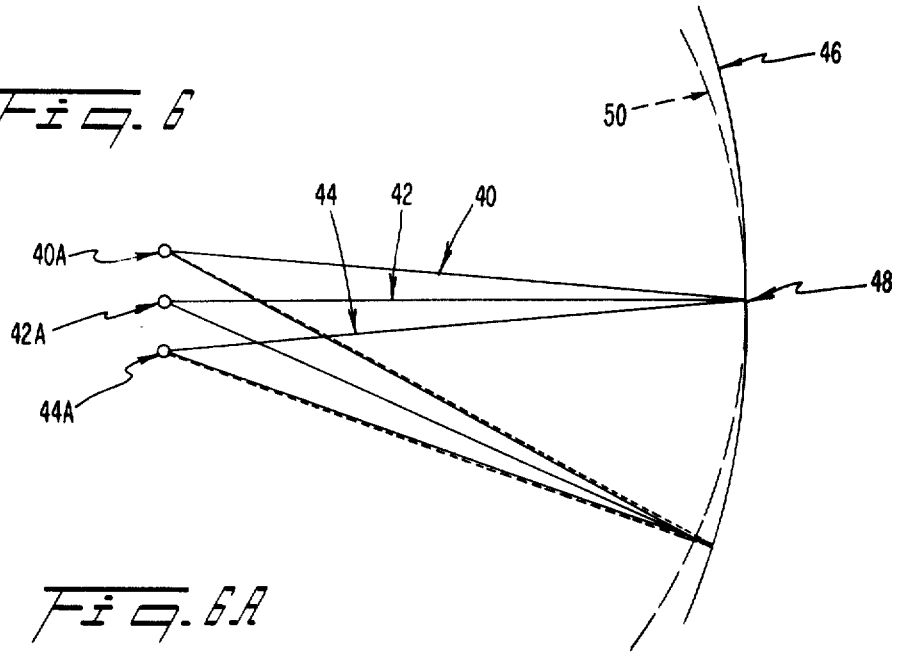
FIG. 6 & 6A illustrate the convergence problem associated with a plural beam cathode ray tube.
Figure 6A:
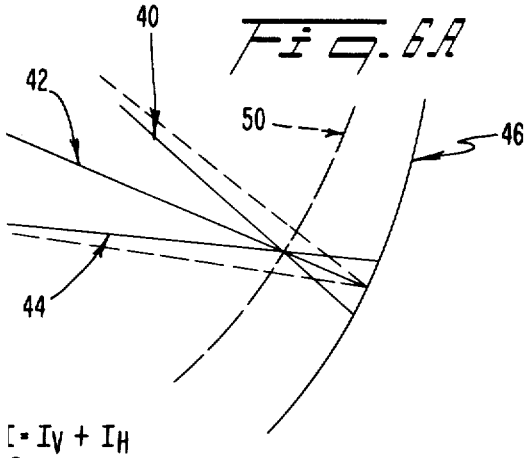

FIG. 6 illustrates the convergence problem associated with a plural beam cathode ray tube. In FIG. 6, three in-line electron beams 40, 42 and 44, illustrated as originating at points 40A, 42A and 44A, are aligned to converge on screen 46 at point 48. If deflection were uniform across the face of the tube, electron beams 40, 42 and 44 would converge at all points along a circle 50 having its center coincident with the source of the beams and lying in the same plane as the beam. However, as illustrated in FIG. 6A, convergence on circle 50 results in misconvergence on screen 46 away from the center axis of the point sources 40A, 42A and 44A. Accordingly, some force is needed to pull beams 40 and 44 away from beam 42 to assure convergence at all points on screen 46.

Quadripolar correction coils are known to correct such convergence errors in plural beam tubes employing either an in-line beam configuration or a triad arrangement. Quadripolar correction coils can also operate to converge or focus a single beam.

Figure 7:
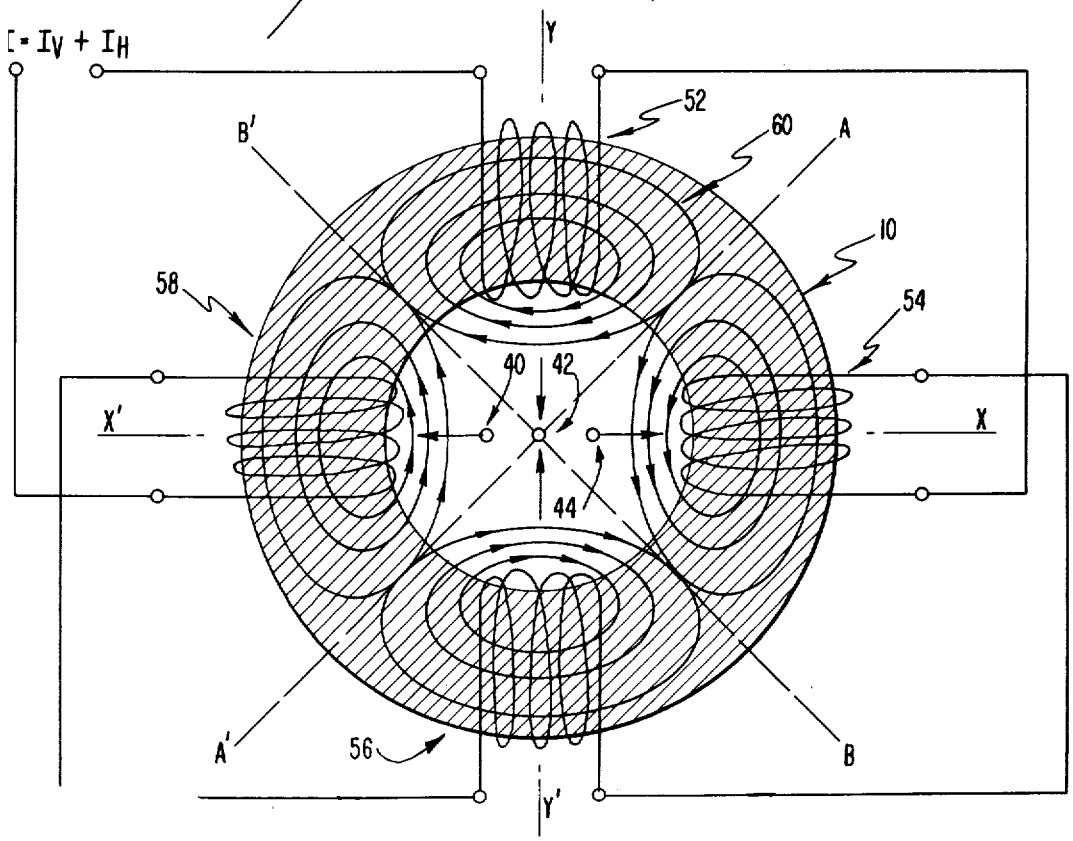
FIG. 7 is a diagrammatic cross section of a quadripolar correction system using toroidal coils.

Referring now to FIG. 7, there is shown a diagrammatic cross section of a quadripolar correction system having a horizontal axis X—X' and a vertical axis Y—Y' and including a ring magnetic core 10, toroidal-type quadripolar coils 52, 54, 56 and 58, and three in-line electron beams 40, 42 and 44, lying on the horizontal axis X—X' of the deflection system, all traveling perpendicular to the plane of the drawing. Flux lines 60 represent the polarity of the magnetic field which toroidal quadripolar coils 52, 54, 56 and 58 set up around the inside core 10. As illustrated, the field results in alternate north and south poles along the diagonals A—A' and B—B' of the system, which poles exert a force pulling beams 40 and 44 away from beam 42 by an amount adjustably selectable to effect complete convergence of the three beams at any location on the screen of a cathode ray tube.

Figure 8:
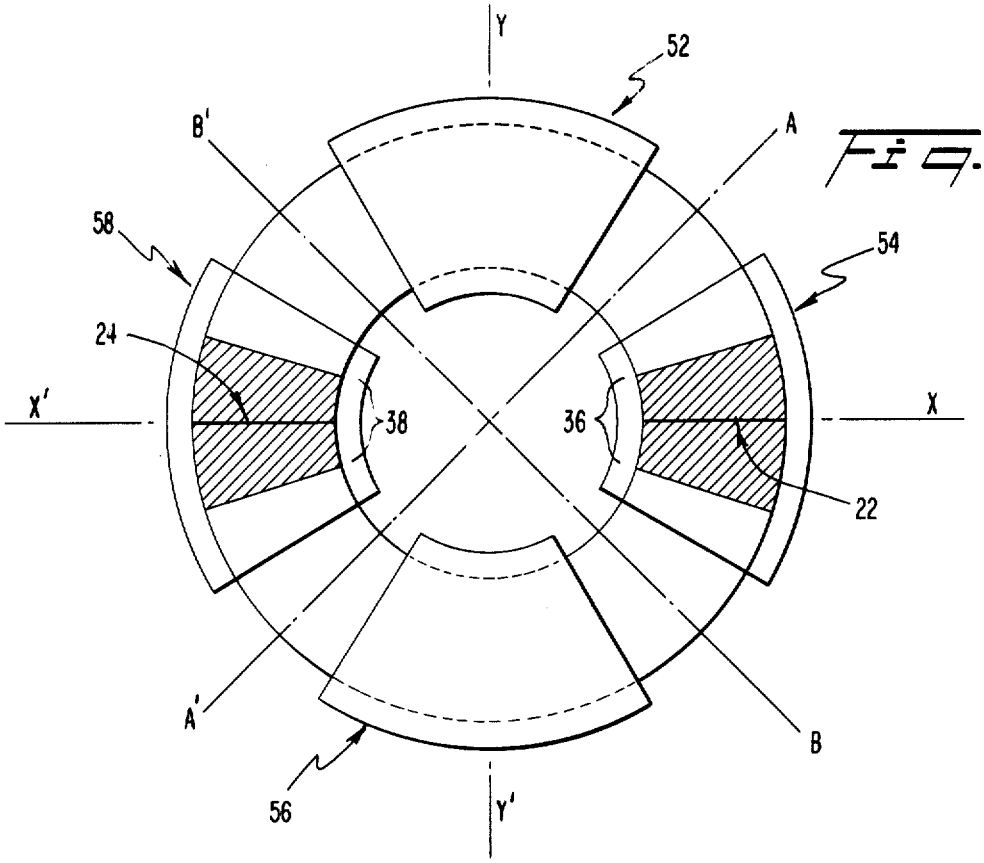
FIG. 8 is a diagram of toroidal-type quadripolar correction coils mounted on a ring core.

In practice, toroidal quadripolar coils 52, 54, 56 and 58 are each centered on core 10 at the intersections of the core and the horizontal and vertical axes of the system as illustrated in FIG. 8. Furthermore, quadripolar coils 54 and 58 completely overlie the limited areas 36 and 38 having no windings between vertical deflection coils 32 and 34 illustrated in FIG. 5 and accordingly, if the quadripolar system illustrated in FIG. 7 and 8 were used with the vertical deflection system illustrated in FIG. 4 and 5, no areas would remain on core 10 at which breaks 22 and 24 of FIG. 3 could be located to allow for the splitting and reassembly of core 10 required if the saddle-type horizontal deflection system illustrated in FIG. 1 and 3 is to be used.

Figure 5:
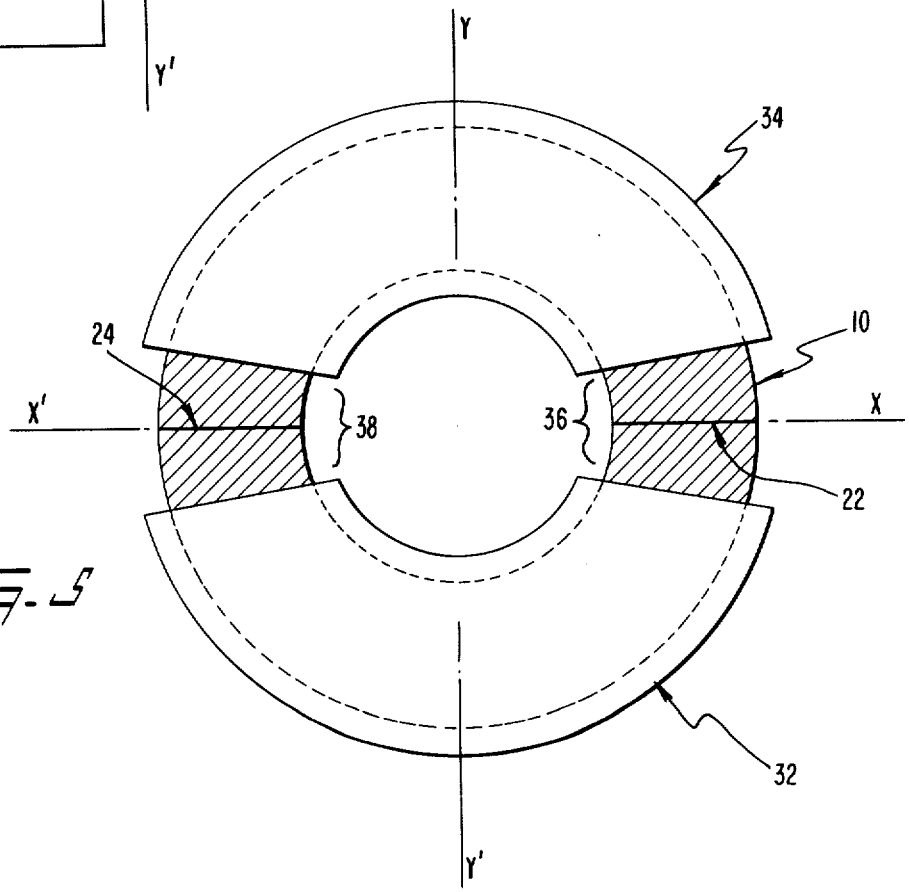
FIG. 5 is a diagram of toroidal vertical deflection coils.

In accordance with the present invention, each of at least two of the toroidal quadripolar windings 52, 54, 56 and 58 has an area void of windings with each void area respectively coincident in part both with one of the limited areas 36 and 38 of FIG. 5 and one of the breaks 22 and 24 of FIG. 3 to allow assembly of core 10. With assembly of core 10 provided for, the complete system can comprise saddle-type horizontal deflection coils, toroidal-type vertical deflection coils and four toroidal-type quadripolar correction coils with the quadripolar coils each centered on the core at the intersections of the core and the horizontal and vertical axes of the system.

A primary advantage of being able to use a hybrid deflection system comprising saddle horizontal deflection coils and toroidal vertical deflection coils is that such a system maintains the low energy consumption of the saddle coils at the high horizontal scanning frequency and also achieves the energy savings of toroidal coils at the low vertical scanning frequency. This saving can be considerable. For example, at 60HZ, a saddle coil of 120 mh has an effective resistance load of about 60 ohms, while a toroidal coil of 120 mh has only a 30 ohm effective load. This results in decreased energy consumption while still producing the quadripolar correction coils in a very commercially practical toroidal fashion.

In accordance with the present invention, the void areas in the quadripolar coils can be represented by means of a Fourier analysis of the winding distribution. While odd series Fourier analysis has been applied to horizontal and vertical deflection coil wire distributions, as evidenced by the Archer patent, even series Fourier analysis can be applied to quadripolar correction coil wire distribution.

Figures 9A, 9B, 9C, 9D, 9E:
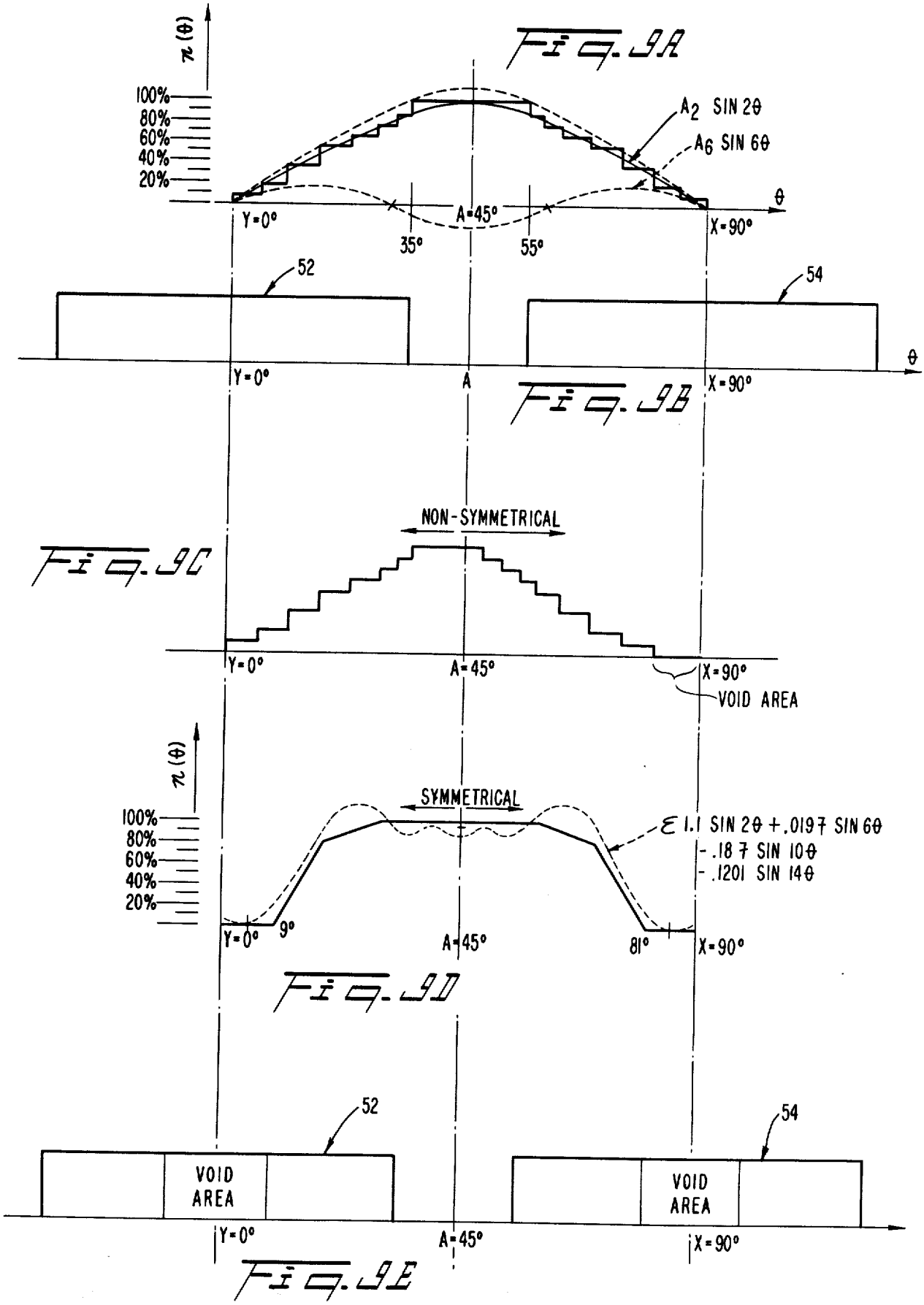
FIG. 9A shows an example of the coil distribution for portions of quadripolar coils in FIG. 8.
FIG. 9B shows the coil distribution of quadripolar coils in FIG. 8 as centered at zero and 90°.
FIG. 9C shows the effect on the coil distribution of the quadripolar coils in FIG. 8 if one of the coils were cut in half to allow for assembly of the core at the X-axis.
FIG. 9E shows the void area distribution of the quadripolar coils under certain conditions.

Referring to FIG. 9A, an example of the coil distribution is shown for portions of quadripolar coils 52, 54 and FIG. 8. For each angle $\theta$, there is shown the number of turns of wire encompassed by $\theta$. From zero degrees the number of turns is shown to increase in an approximately sinusoidal fashion until about 35° at which point the number of turns remains constant until about 55°. At 55°, the number of turns decreases, representing turns wound in the opposite direction, until 90°. The resultant coils 52 and 54 are illustrated in FIG. 9B to be centered at zero and 90° respectively.

The distributions illustrated in FIG. 9A can be represented by an even series Fourier analysis. For example, given an even Fourier series:

$$n(\theta) = N[A_2\mathrm{Sin}2\theta + A_j\mathrm{Sin}_4\theta + A_6\mathrm{Sin}6\theta + \ldots A_j\mathrm{Sin}_j\theta]$$

$n(\theta)$ represents the number of turns of wire encompassed by an angle $\theta$, in the first quadrant of core 10 between the Y and X axes, $\theta = 0$ along the Y axis, 45° along the A axis, and 90° along the X axis. The term N equals the total number of turns encompassed by 45°.

As illustrated in FIG. 9A by the terms $A_2 Sin2\theta$ and $A_6 Sin6\theta$ which are symmetrical about the A axis, coefficients $A_2$ and $A_6$ can be selected such that even Fourier series $n(\theta)$ approximates the wire distribution of FIG. 9A. With a distribution having known Fourier terms or harmonics, the design of the entire deflection system is simplified. In addition, experience has revealed that best results in terms of ease of deflection system design are achieved when the distribution is symmetrical about the A and B axes. This symmetry is achieved by an even series Fourier distribution in which terms evenly divisible by four equal zero since such terms are not symmetrical about the A and B axes.

When used in all four quadrants of core 10, a distribution symmetrical about the diagonal A and B axes does provide a magnetic field as illustrated by flux lines 60 in FIG. 7 with equal and offsetting vertical forces on electron beams 40, 42, and 44. The equal and offsetting vertical forces are particularly important with an in-line beam configuration because no vertical convergence corrections are required and any unequal vertical forces would introduce undesired effects.

However, the distribution illustrated in FIG. 9A allows no room on core 10 for splits and reassembly along the X axis as is required for use with a hybrid deflection system comprising saddle horizontal deflection coils and toroidal vertical deflection coils. If coil 54 were merely cut in half and pushed apart to allow for assembly of the core at the X axis, a distribution as illustrated in FIG. 9C would result. This distribution can no longer be represented by a simple even series Fourier analysis having known and easily worked with harmonics. At the very least, due to the lack of symmetry about the A axis, undesirable fourth order harmonics are needed to mathematically represent the distribution.

In accordance with the present invention, void areas are introduced along the horizontal and vertical axes of the core while maintaining equal and offsetting vertical forces on the electron beams by using a coil distribution selection which can be expressed by an even Fourier series having a set of coefficients which result in void areas coincident with the X and Y axes of the system. For example, with:

$A_2 = 1.08$
$A_4 = 0$
$A_6 = 0.0197$
$A_8 = 0$
$A_{10} = -0.1870$
$A_{12} = 0$
$A_{14} = -0.1201$ $n(\theta)$ results in a distribution as approximately illustrated by FIG. 9D. In FIG. 9D, void areas exist from $\theta$ equal zero to about 9° and from $\theta$ equals 81° to $\theta$ equals 90° at the X-axis. When applied to all four quadrants of the core, the resulting distribution leaves, as illustrated in FIG. 9E, void areas of 18° magnitude in each quadripolar coil, coincident with the horizontal and vertical axes of the system.

Figure 10:
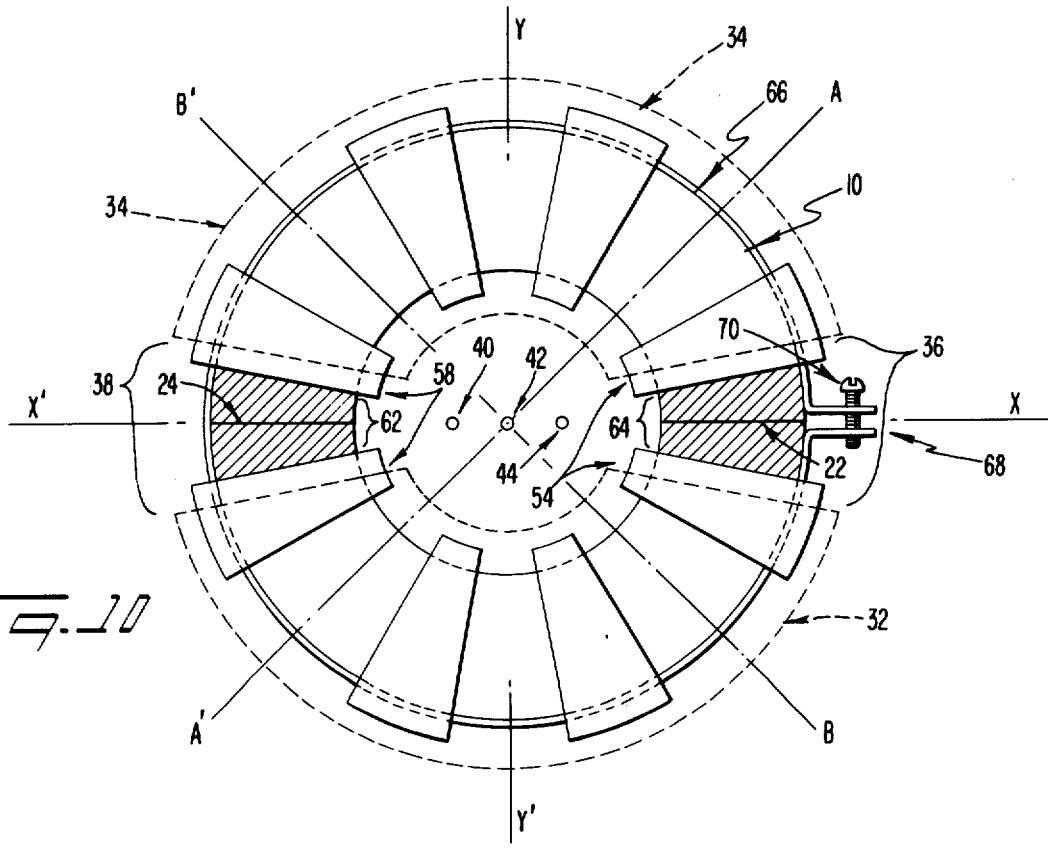
FIG. 10 is a diagram of saddle horizontal deflection coils, toroidal vertical deflection coils and toroidal quadripolar correction coils mounted on a split ring magnetic core in accordance with the teachings of the present invention.

As illustrated in FIG. 10, the values of the coefficients are chosen to provide large enough void areas 62 and 64 at the X-axis to allow for mechanical assembly of core 10. Typically, this assembly is effected by a metallic strap 66 encircling the outside of core 10 with outwardly protruding ends 68 through which a screw or other fastening device 70 can be secured. With quadripolar coils 54 and 58 overlying limited areas 36 and 38 between toroidal vertical deflection coils 32 and 34, void areas 62 and 64 of quadripolar coils 54 and 58 are each coincident with both one of the limited areas 36 and 38 and one of the breaks 22 and 24 in core 10 to allow assembly to core 10. To assure equal and offsetting vertical forces on electron beams 40, 42 and 44, each quadrant A—B, B—A', A'—B' and B'—A of core 10 is wound with the same quadripolar coil Fourier distribution resulting in void areas conincident with each intersection of core 10 and the horizontal and vertical axes of the system. In addition, each void area is of equal size resulting in a symmetrical magnetic field.

In accordance with the present invention, winding distribution $n(\theta)$ may contain higher terms of an even series Fourier distribution to achieve desired quadripolar correction. In a preferred embodiment, however, each term of the even series Fourier distribution evenly divisible by four is equal to zero. The reason for elimination of these terms can be seen by reference once again to the fact that all terms evenly divisible by four are non-symmetrical about the diagonal axes of the system and hence introduce a non-symmetrical magnetic field to the quadripolar correction system. While this might be desirable in select instances, generally such a non-symmetrical magnetic field results in unwanted forces on electron beams 40, 42 and 44.

Use of an even Fourier series analysis to identify the void areas in the quadripolar coils and thereby allow for a hybrid deflection system comprising saddle horizontal deflection coils, toroidal vertical deflection coils and toroidal quadripolar correction coils is commercially advantageous since once the relation between the coefficients of the terms is established for a particular deflection system, this relationship is then maintained regardless of the total number of turns used to complete the quadripolar coils. It should be noted that the Fourier analysis as taught by this invention can also be applied when void areas are required off the horizontal axis or when non-uniform quadripolar magnetic fields are required.

While a particular embodiment of the present invention has been shown and described, it will of course be obvious to one skilled in the art that certain advantages and modifications may be effected without departing from the spirit of the invention, and accordingly, it is intended that the scope of the invention not be determined by the foregoing examples but only by the scope of the appended claims.

What is claimed is:

1. A deflection system for use with a cathode ray tube comprising:

horizontal and vertical deflection means including a split ring magnetic core having two breaks therein and further including a coil configuration which results in at least two limited areas having no windings on said core at which limited areas said breaks are located; and quadripolar correction means having a plurality of coils, at least a portion of said quadripolar coils covering said limited areas on said core, each of two of said quadripolar coils having areas void of windings with each void area coincident with one of said breaks in said core and of sufficient magnitude to allow assembly of said core.

2. The invention recited in claim 1 wherein said horizontal coil configuration is of the saddle-type and said vertical coil configuration is of the toroidal-type, said vertical coil configuration resulting in only two of said limited areas having no windings and said two limited areas being diametrically located along the intersections of the core and horizontal axis of the deflection system.

3. The invention recited in claim 2 wherein said quadripolar correction means comprises four toroidal quadripolar coils, said quadripolar coils each being centered at horizontal and vertical axes of said deflection system, said quadripolar coils centered at the horizontal axis of the deflection system each having a void area located at the horizontal axis of the deflection system of sufficient magnitude to allow said core to be assembled along said horizontal axis.

4. The invention recited in claim 3 wherein each of said four quadripolar coils is symmetrical with equal size void areas.

5. The invention recited in claim 3 wherein said quadripolar coils are each wound in accordance with an even Fourier series distribution.

6. The invention recited in claim 5 wherein the terms of said Fourier distribution evenly divisible by four are equal to zero.

7. A deflection system for use with a cathode ray tube comprising:

saddle-type horizontal deflection coils; toroidal-type vertical deflection coils; and toroidal-typequadripolar convergence coils; wherein said toroidal-type vertical deflection coils and said toroidal-type quadripolar convergence coils are wound onto a split ring magnetic core, said core having a split which is coincident with the horizontal axis of said deflection system.

8. The deflection system set forth in claim 7 wherein:

said toroidal-type quadripolar convergence coils comprise four coils with the first two of said four convergence coils being diametrically positioned on said core coincident with the horizontal axis of said deflection system, the windings of each of said first two coils being spaced apart to form void areas on said core at the intersections of said core and said horizontal axis of said deflection system of sufficient size to allow for assembly of said split ring core.

9. The deflection system set forth in claim 8 wherein a second two of said convergence coils are diametrically positioned on said core coincident with the vertical axis of said deflection system, the windings of each of said second two coils being spaced apart to form void areas in said second two convergence coils at the intersections of said core and said vertical axis of said deflection system.

10. The deflection system set forth in claim 9 wherein said void areas on said core are all identical in size.

11. The deflection system set forth in claim 9 wherein said convergence coils are wound in accordance with an even series Fourier distribution.

12. The deflection system set forth in claim 11 wherein each term of the even series Fourier distribution evenly divisible by four equals zero.

13. A hybrid deflection system with quadripolar correction coils for use with a plural gun cathode ray tube having an inline configuration along the horizontal axis of the deflection system, said system comprising:

a split ring magnetic core having two diametrically positioned breaks along the horizontal axis of the system;

saddle-shaped horizontal deflection coils requiring separation and reassembly of said core to effect mounting of said horizontal coils on said core;

toroidal-shaped vertical deflection coils wound on said core and having two limited areas having no windings on said core each limited area being coincident with one of said breaks in said core;

toroidal-shaped quadripolar correction means for providing alternate north and south magnetic poles on the diagonals of said system, said quadripolar means comprising four quadripolar toroidal coils, a first two of said quadripolar coils being diametrically positioned on said core at the horizontal axis of said system and a second two of said quadripolar coils being diametrically positioned on said core at the vertical axis of said system, each of said quadripolar coils having an area void of windings at its intersection with said horizontal and vertical axes to provide a uniform quadripolar correction field and yet allow assembly of said coil along said horizontal axis of said system.

14. The invention recited in claim 13 wherein said quadripolar coils are wound in accordance with an even series Fourier distribution.

15. The invention recited in claim 14 wherein each term of the even series Fourier distribution evenly divisible by four equals zero.

* * * * *